US012274323B2

(12) United States Patent
Huang

(10) Patent No.: US 12,274,323 B2
(45) Date of Patent: Apr. 15, 2025

(54) DEVICE FOR CONNECTING LENS AND EARMUFF TO SAFETY HELMET

(71) Applicant: OURAD SAFETY CO., LTD., Tainan (TW)

(72) Inventor: Pin-Tsung Huang, Tainan (TW)

(73) Assignee: OURAD SAFETY CO., LTD., Tainan (TW)

( * ) Notice: Subject to any disclaimer, the term of this patent is extended or adjusted under 35 U.S.C. 154(b) by 51 days.

(21) Appl. No.: 18/337,831

(22) Filed: Jun. 20, 2023

(65) Prior Publication Data

US 2024/0423313 A1 Dec. 26, 2024

(51) Int. Cl.

| | |
|---|---|
| ***A42B 3/16*** | (2006.01) |
| ***A42B 3/22*** | (2006.01) |
| *A42B 1/24* | (2021.01) |

(52) U.S. Cl.

CPC ..... *A42B 3/163* (2013.01); *A42B 3/222* (2013.01); *A42B 3/225* (2013.01); *A42B 1/24* (2013.01); *A42B 3/16* (2013.01); *A42B 3/166* (2013.01); *A42B 3/22* (2013.01); *A42B 3/221* (2013.01); *A42B 3/223* (2013.01)

(58) Field of Classification Search

CPC ..... A42B 1/24; A42B 3/221; A42B 3/223; A42B 3/225; A42B 3/222; A42B 3/22; A42B 3/16; A42B 3/163; A42B 3/166

USPC ..... 2/410

See application file for complete search history.

(56) References Cited

U.S. PATENT DOCUMENTS

| | | | | | |
|---|---|---|---|---|---|
| 3,273,164 | A * | 9/1966 | Thomas | A42B 3/166 | 2/209 |
| 4,222,123 | A * | 9/1980 | Hellberg | A61F 9/06 | 2/10 |
| 4,547,908 | A * | 10/1985 | Karlsson | A42B 3/166 | 2/10 |
| 5,009,496 | A * | 4/1991 | Holtan, Jr. | A42B 1/247 | 351/123 |
| 5,090,061 | A * | 2/1992 | Kamata | A42B 3/16 | 2/423 |

(Continued)

FOREIGN PATENT DOCUMENTS

| | | |
|---|---|---|
| CN | 211833050 U | 11/2020 |
| TW | M366314 U | 10/2009 |
| TW | M595976 U | 6/2020 |

*Primary Examiner* — Khaled Annis
*Assistant Examiner* — Dakota Marin
(74) *Attorney, Agent, or Firm* — Rosenberg, Klein & Lee

(57) ABSTRACT

A device for connecting a lens and an earmuff to a safety helmet is disclosed. The device includes a retaining frame, two pivot members and two connecting units. The retaining frame includes a pivot portion on either side thereof and an engaging block on the pivot portion. The pivot members are pivotally connected to the pivot portions, respectively. The pivot member has a slide portion having a first groove. The first pressing block is positioned in the first groove. The pivot member further includes a positioning strip having a plurality of second grooves. The connecting unit has a second slide groove. The positioning strip is inserted and slidable in the second slide groove. A second pressing block is disposed on an inner wall of the second slide groove. The second pressing block is pressed into any one of the second grooves in a multi-step manner.

9 Claims, 14 Drawing Sheets

(56) References Cited

U.S. PATENT DOCUMENTS 5,133,596 A * 7/1992 Korny ..... G02C 1/06 351/158
5,323,493 A * 6/1994 Ogiba ..... G02C 3/02 2/10
5,361,419 A * 11/1994 Bernstein ..... A42B 3/30 2/209
5,546,610 A * 8/1996 Herzig ..... A42B 3/166 2/424
5,638,147 A * 6/1997 Wang-Lee ..... G02C 5/10 351/120
6,352,383 B1 * 3/2002 Ristola ..... A42B 3/04 403/162
6,795,977 B2 * 9/2004 Basson ..... A42B 3/32 2/6.3
7,398,561 B2 * 7/2008 Kim ..... A42B 3/222 2/424
7,409,723 B2 * 8/2008 Huh ..... A42B 3/04 2/8.2
8,245,320 B2 * 8/2012 Provost ..... A42B 3/185 2/442
8,286,269 B2 * 10/2012 Springer ..... G02C 3/02 2/10
8,291,512 B2 * 10/2012 Stoll ..... A41D 13/1184 2/418
8,732,864 B2 * 5/2014 Fountain ..... A61F 11/14 2/209
8,806,667 B2 * 8/2014 Pfanner ..... A42B 3/222 2/424
10,154,704 B1 * 12/2018 Caito, III ..... A42B 3/223
10,165,819 B2 * 1/2019 Klotz ..... A42B 3/04
10,912,344 B2 * 2/2021 Bohn ..... A42B 3/16
11,160,323 B2 * 11/2021 Sanders ..... A42B 3/223
11,786,405 B2 * 10/2023 Huang ..... A41D 13/1184 2/427
2004/0199982 A1 * 10/2004 Wang-Lee ..... A42B 3/225 2/10
2005/0028250 A1 * 2/2005 Zaic ..... A42B 3/16 2/209
2012/0272484 A1 * 11/2012 Willborn ..... A61F 9/029 24/3.12
2019/0008228 A1 * 1/2019 Ramey ..... A42B 1/24
2020/0178638 A1 * 6/2020 Morales Velasquez . A42B 3/16
2021/0330019 A1 * 10/2021 Scharpenack ..... A42B 3/22

* cited by examiner

DEVICE FOR CONNECTING LENS AND EARMUFF TO SAFETY HELMET

FIELD OF THE INVENTION

The present invention relates to a device for connecting a lens and an earmuff to a safety helmet, so as to meet the requirement of reducing carbon emissions.

BACKGROUND OF THE INVENTION

In general, a hard hat or safety helmet is combined with a lens to protect the user's face and eyes if necessary for welding or other engineering operations.

Taiwan Utility Model Publication No. M595976 discloses a helmet and an eye protection device thereof published on Jun. 1, 2020. The helmet includes a helmet body and an eye protection device. The helmet body includes a head cover portion, a brim portion, and two mounting portions. The eye protection device includes two connecting rods installed to the respective mounting portions, two linkage units pivotally connected to the connecting rods in a left-to-right axial direction, and a lens unit pivotally connected to the linkage units. Each connecting rod has a plurality of engaging members spaced in a front-to-rear direction. The engaging members are detachably engaged with positioning members of the corresponding mounting portion. Each connecting rod can be moved back and forth and positioned by the engaging members in cooperation with the positioning members of the corresponding mounting portion. In this way, the lens unit can be operated to drive the linkage units to pivot up and down relative to the connecting rods, so as to change between a storage position above the brim and a wearing position below the brim. This helmet is a structure that can be combined with lenses only. When the wearer encounters noise at work, this helmet cannot prevent noise effectively.

Taiwan Utility Model Publication No. M366314 discloses an improved structure of an anti-noise hard hat published on Oct. 11, 2009. The anti-noise hard hat comprises a hat body, a cover frame and an anti-noise structure. The cover frame and the anti-noise structure are assembled to the hat body. The hat body has locking grooves on both sides thereof. The anti-noise structure includes a retaining seat, a connecting rod, a pivot seat, earplugs, earmuffs and other components. The retaining seat has a retaining hole. The bottom edge of the retaining seat has an insert to be inserted into the locking groove of the hat body, so that the connecting rod and the pivot seat are connected to the retaining seat for connecting the earplugs or earmuffs. The lens is mounted on the cover frame to form an anti-noise hard hat.

In the above-mentioned patent, when the earmuffs are connected, the locking grooves on both sides of the hat body cannot be used for insertion of the lens. It is necessary to manufacture a hat body structure that is able to fit earmuffs or lens. Therefore, it is required to use more than four components for connection, unable to optimize overall construction. Using more components needs more plastics. In these days, countries around the world have a certain consensus on "reducing the use of plastics". "Plastic reduction" has become the common goal of most enterprises, and it is also the claim and demand of government policy. Plastic reduction can achieve the purpose of reducing carbon emissions, so as to conform to the world trend. Therefore, the use of more (four) components leads to an increase in the use of plastics. It is obviously contrary to the current "plastic reduction" policy, and it is difficult to meet the environmental protection requirements of reducing carbon emissions.

Besides, Due to the large number of parts, the assembly is cumbersome, time-consuming, and high failure rate. It cannot be universally used in general hat body structures, so it is not ideal in use.

SUMMARY OF THE INVENTION

In view of the drawbacks of the prior art, the primary object of the present invention is to provide a device for connecting a lens and an earmuff to a safety helmet, comprising a retaining frame, two pivot members and two connecting units. The retaining frame includes a pivot portion on either side of the retaining frame, an engaging block on an inner side of the pivot portion, and a first pressing block on a periphery of the pivot portion. The two pivot members are pivotally connected to the two pivot portions of the retaining frame, respectively. The pivot member has an engaging slot corresponding in position and in shape to the engaging block. The engaging slot has a width greater than that of the engaging block for the engaging block to pass through the engaging slot. The pivot member is rotatably connected to the pivot portion. A slide portion is provided on a periphery of the pivot member and corresponds in position to the first pressing block. The slide portion has at least one first groove. When the pivot portion is turned relative to the pivot member, the first pressing block is forced to be positioned in the first groove so that the retaining frame is turned to an angle relative to the pivot member. The pivot member further includes a positioning strip extending backward and a plurality of second grooves that are arranged continuously on an outer side of the positioning strip. The two connecting units are coupled to the two pivot members, respectively. The connecting unit has a second slide groove on an inner side thereof. The positioning strip is inserted and slidable in the second slide groove. A second pressing block is disposed on an inner wall of the second slide groove. The second pressing block is pressed into any one of the second grooves in a multi-step manner so that the pivot member can slide and extend to a length relative to the connecting unit. The connecting unit further includes an elastic insert.

The retaining frame further includes a curved retaining face on a front edge thereof, a plurality of positioning posts on the retaining face, and at least one stop piece protruding from a top edge of the retaining face.

The device further comprises a lens. A top edge of the lens has a plurality of positioning holes. The positioning posts of the retaining frame are inserted and positioned in the respective positioning holes of the lens. The stop piece is configured to prevent the lens from detaching from the retaining frame.

The engaging block is a linear block, and the engaging groove is a linear groove.

Positioning blocks are disposed on upper and lower sides of the second groove, so as to prevent the positioning strip from sliding out of the second groove.

The device further comprises a safety helmet. A fitting groove is formed on either side of the safety helmet. The elastic insert is embedded and secured in the fitting groove.

The elastic insert is located below the second slide groove.

The connecting unit further includes a locking portion on an outer side thereof and two stoppers above the locking portion.

The device further comprises an earmuff. The earmuff is locked to the corresponding connecting unit. The earmuff includes a locking block on an upper end thereof and a protruding plate on a top edge of the locking block. The locking block is locked in the locking portion, and the protruding plate is engaged in the two stoppers, so as to prevent the earmuff from detaching from the corresponding connecting unit.

According to above-mentioned technical features, the present invention has the following advantage:

1. Through three components, the retaining frame, the pivot member and the connecting unit, both the lens and the earmuff can be secured to the safety helmet for use. There will be no disadvantage that only one of the lens and the earmuff can be used. Compared with the prior art that includes more than four components, the present invention reduces the use of plastics to reduce the plasticizers in plastics to produce "environmental hormones" that enter the human body. This can avoid the influence of hormones or destroy the balance and function of the original endocrine system and prevent adverse effects on the growth, development and reproduction of the human body. Therefore, by reducing the use of plastics, the health of the human body can be improved.
2. The components are very simple, and the disassembly and assembly are relatively easy.
3. The present invention is suitable for the fitting and use of the general safety helmet. There is no need to use another mold for manufacturing a lens or an earmuff that can cooperate with the safety helmet. Therefore, the manufacturing cost and the man-hours can be reduced greatly.
4. The present invention can match the length of the brim of a different safety helmet or match the height of a different safety helmet. By moving the pivot member relative to the connecting unit, the lens can be slid and protruded to an appropriate length relative to the connecting unit, so that the lens can be flipped for a safety helmet having a different length of the brim or a different height.

DETAILED DESCRIPTION OF THE PREFERRED EMBODIMENTS

Embodiments of the present invention will now be described, by way of example only, with reference to the accompanying drawings.

Figure 1:
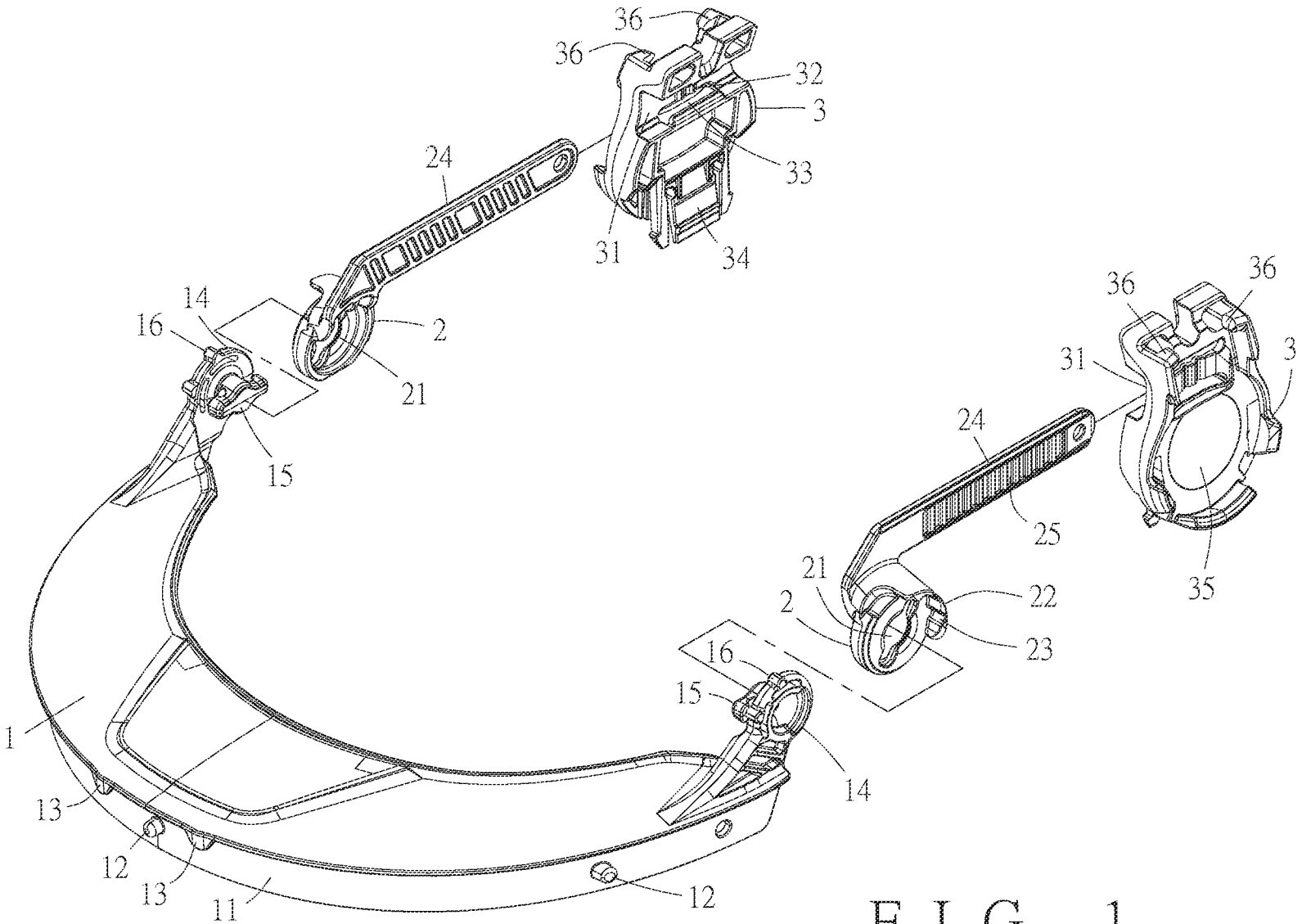
FIG. 1 is an exploded view of an embodiment of the present invention.
Figure 2:
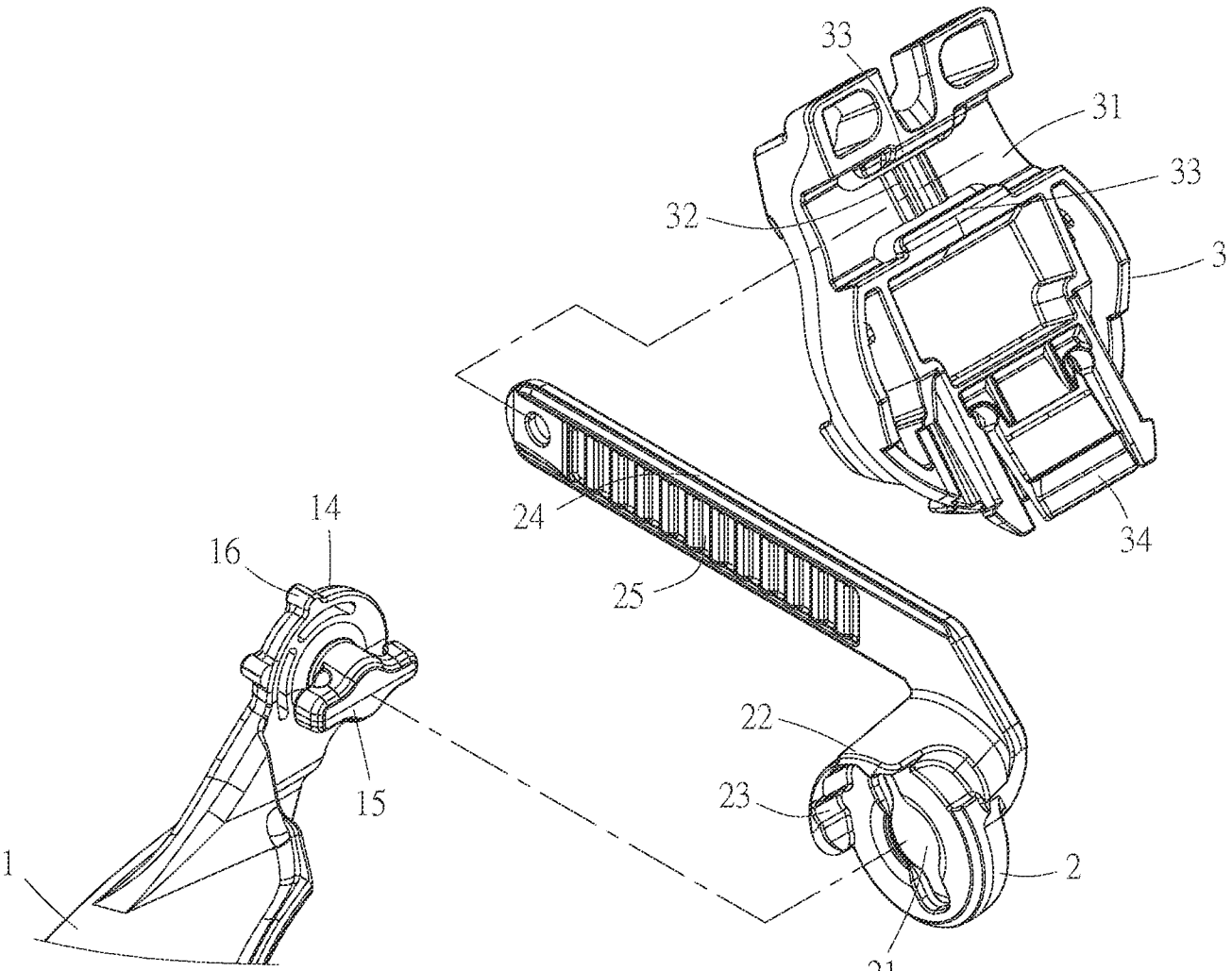
FIG. 2 is a partial, exploded view of the embodiment of the present invention.
Figure 3:
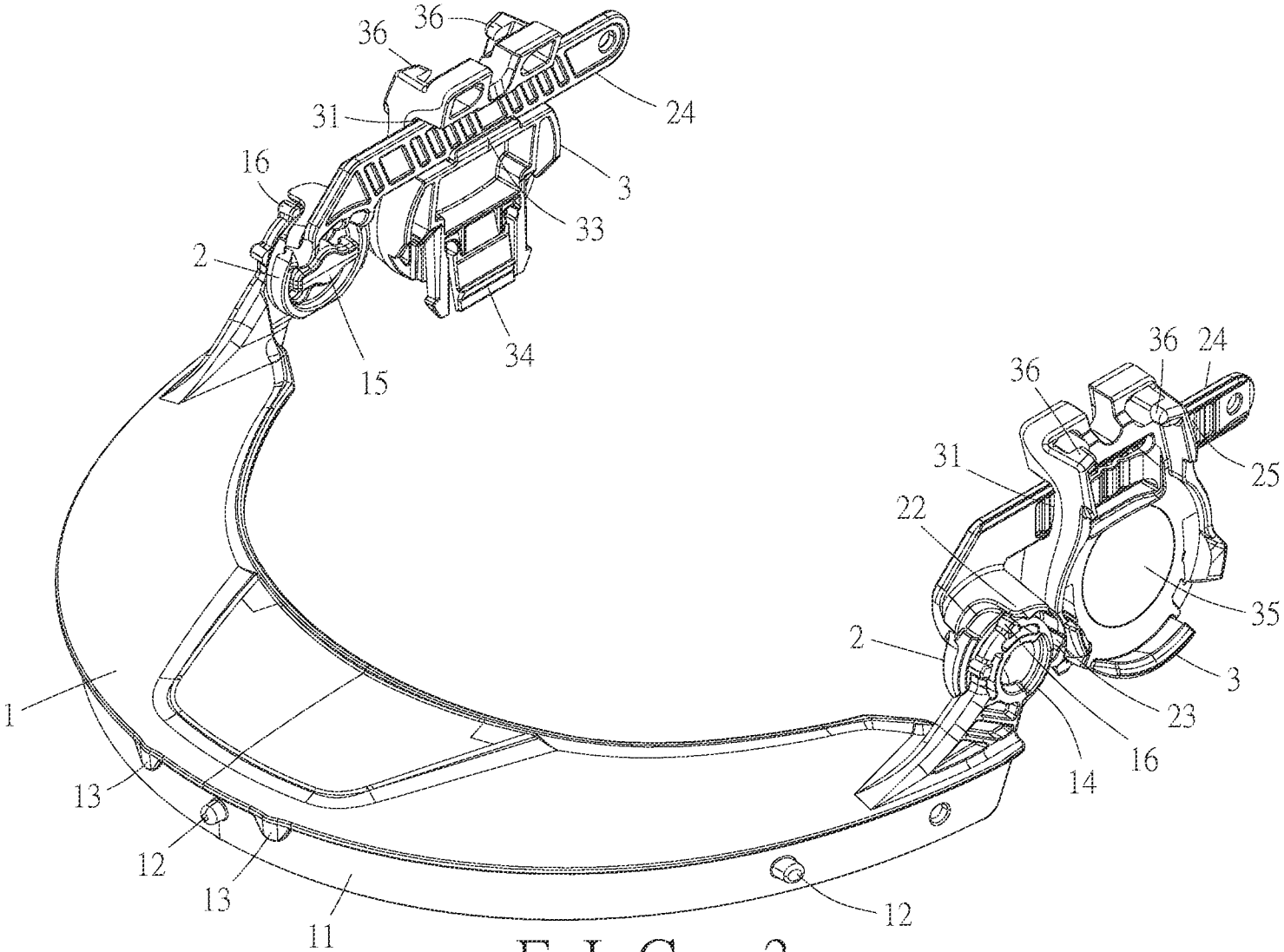
FIG. 3 is a perspective view of the embodiment of the present invention.

As shown in FIG. 1, FIG. 2, and FIG. 3, the embodiment of the present invention comprises a retaining frame 1, two pivot members 2, and two connecting units 3.

The retaining frame 1 includes a curved retaining face 11 on a front edge thereof, a plurality of positioning posts 12 on the retaining face 11, and at least one stop piece 13 protruding from a top edge of the retaining face 11. A pivot portion 14 is disposed on either side of the retaining frame 1. An engaging block 15 is disposed on an inner side of the pivot portion 14. The engaging block is a linear block. A first pressing block 16 is disposed on the periphery of the pivot portion 14.

Figure 4:
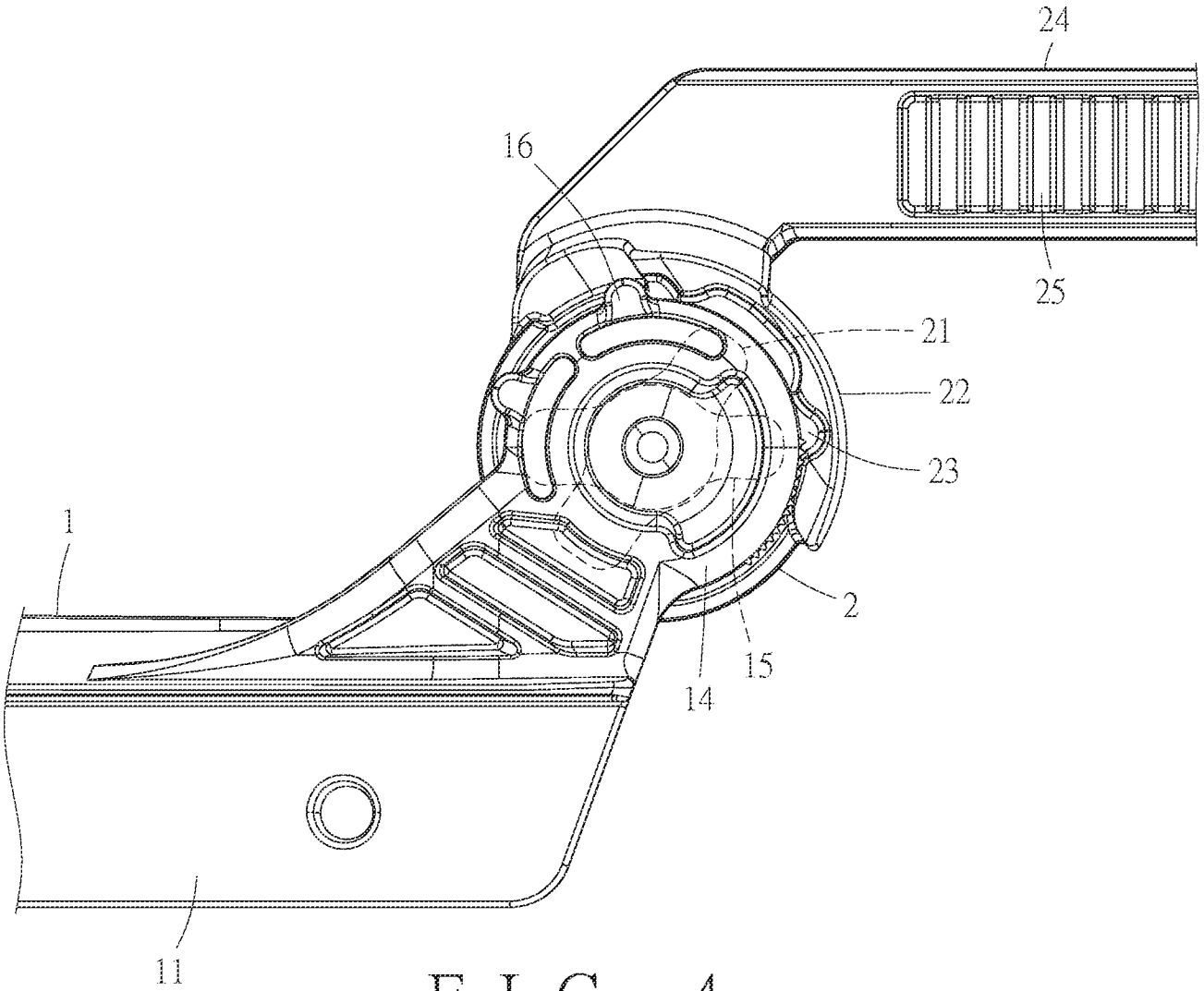
FIG. 4 is a schematic view showing the connection of the pivot member and the pivot portion of the embodiment of the present invention.
Figure 5:
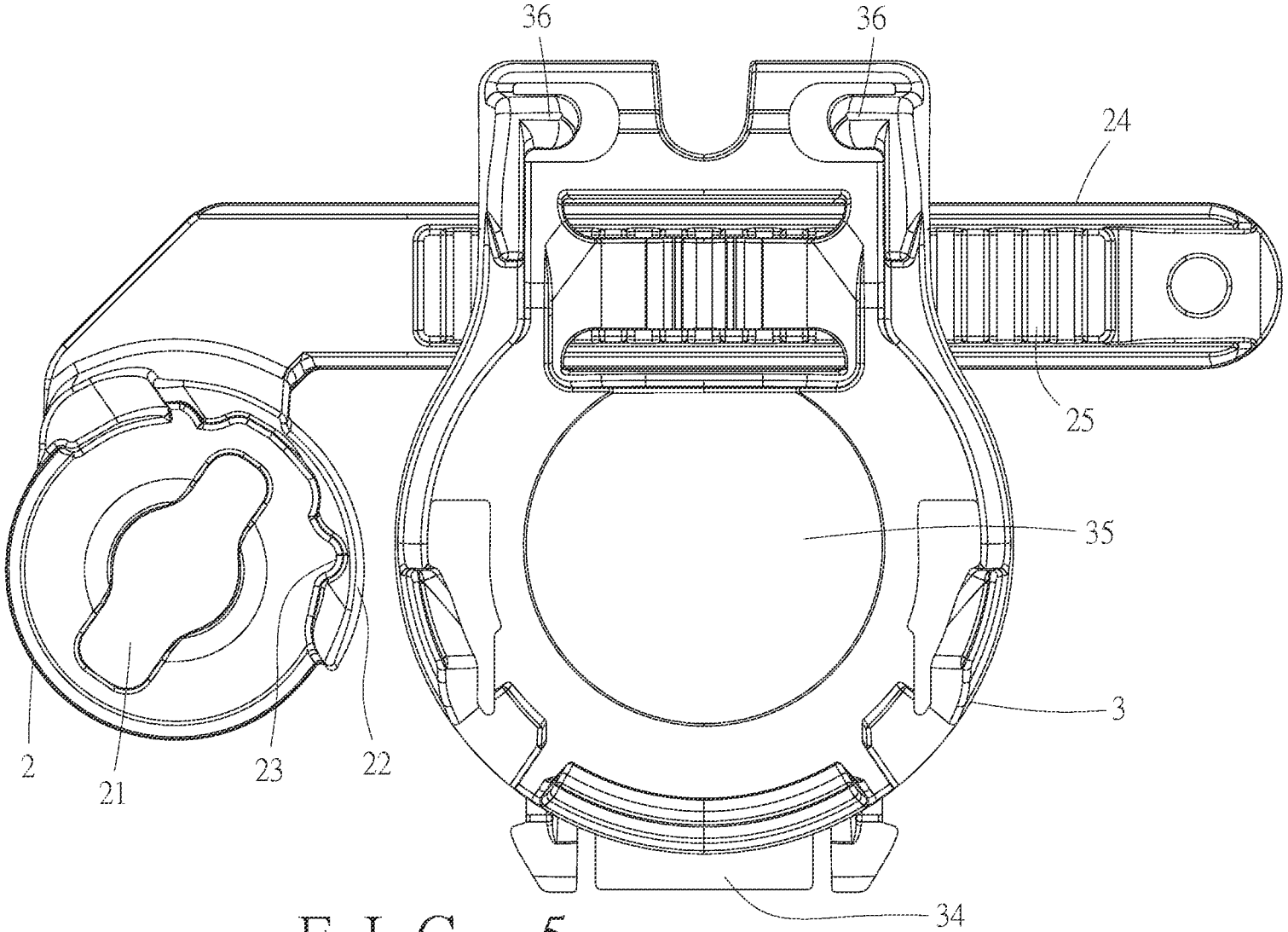
FIG. 5 is a schematic view showing the connection of the connecting member and the pivot member of the embodiment of the present invention.
Figure 6:
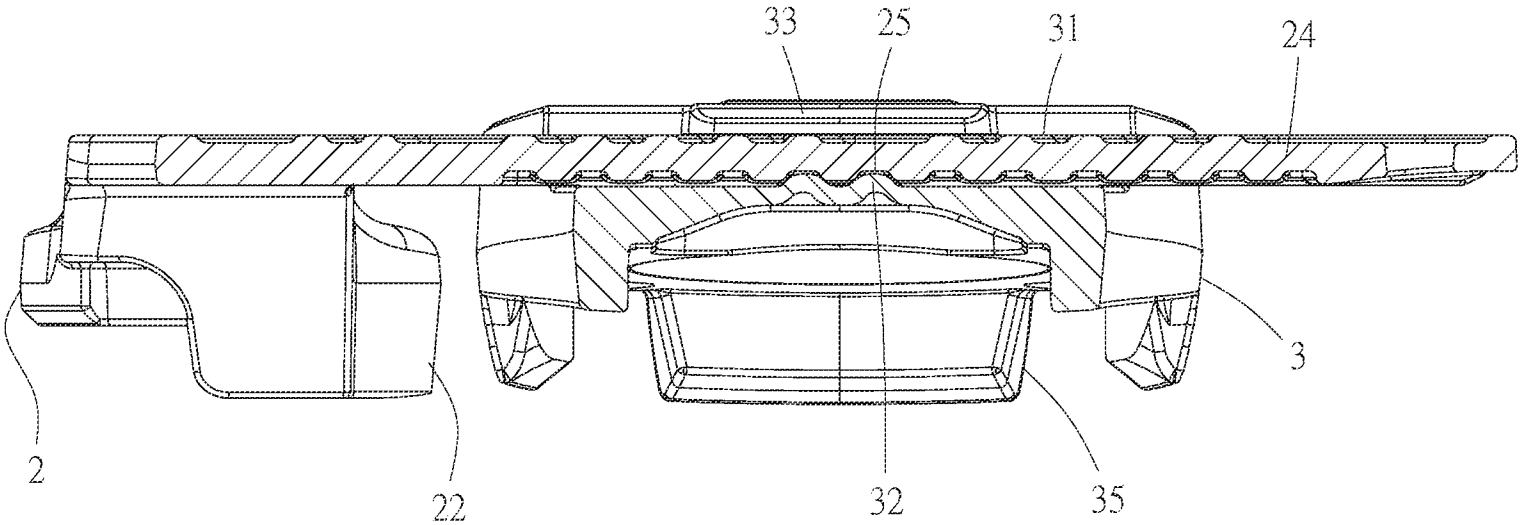
FIG. 6 is a cross-sectional view showing the assembly of the connecting member and the pivot member of the embodiment of the present invention.
Figure 13:
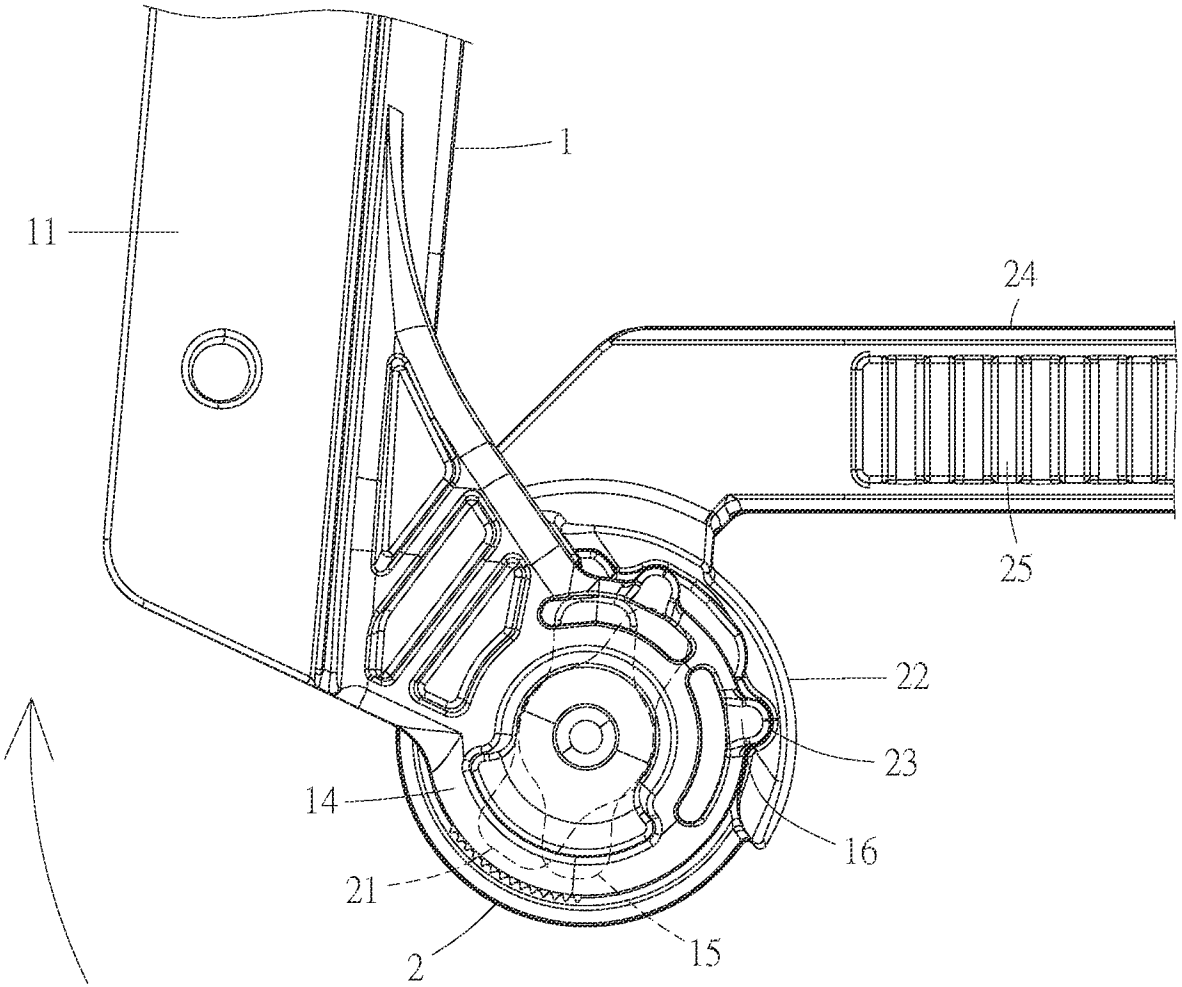
FIG. 13 is a schematic view of the embodiment of the present invention, wherein the pivot portion is turned relative to the pivot member.

The two pivot members 2 are pivotally connected to the two pivot portions 14, respectively. As shown in FIG. 4, FIG. 5 and FIG. 6, the pivot member 2 has an engaging slot 21 corresponding in position and in shape to the engaging block 15. The width of the engaging slot 21 is slightly greater than that of the engaging block 15 for the engaging block 15 to pass through the engaging slot 21. Then, the pivot member 2 is rotatably connected to the pivot portion 14. A slide portion 22 is provided on the periphery of the pivot member 2, corresponding in position to the first pressing block 16. The slide portion 22 has at least one first groove 23. When the pivot portion 14 is rotated relative to the pivot member 2, the first pressing block 16 is forced to be positioned in the first groove 23 (as shown in FIG. 13) so that the retaining frame 1 is rotated to an appropriate angle relative to the pivot member 2. The pivot member 2 further includes a positioning strip 24 extending backward and a plurality of second grooves 25 that are arranged continuously on an outer side of the positioning strip 24.

The two connecting units 3 are coupled to the two pivot members 2, respectively. The two connecting units 3 each have a second slide groove 31 on an inner side thereof, so that the positioning strip 24 is inserted and slidable in the second slide groove 31. A second pressing block 32 is disposed on the inner wall of the second slide groove 31. The second pressing block 32 is pressed into any one of the second grooves 25 in a multi-step manner, so that the pivot member 2 (together with the retaining frame 1) can slide and extend to an appropriate length relative to the connecting unit 3. Positioning blocks 33 are disposed on the upper and lower sides of the second groove 31, so as to prevent the positioning strip 24 from sliding out of the second groove 31. The connecting unit 3 further includes an elastic insert 34 below the second slide groove 31. The connecting unit 3 further includes a locking portion 35 on an outer side thereof and two stoppers 36 above the locking portion 35.

Figure 7:
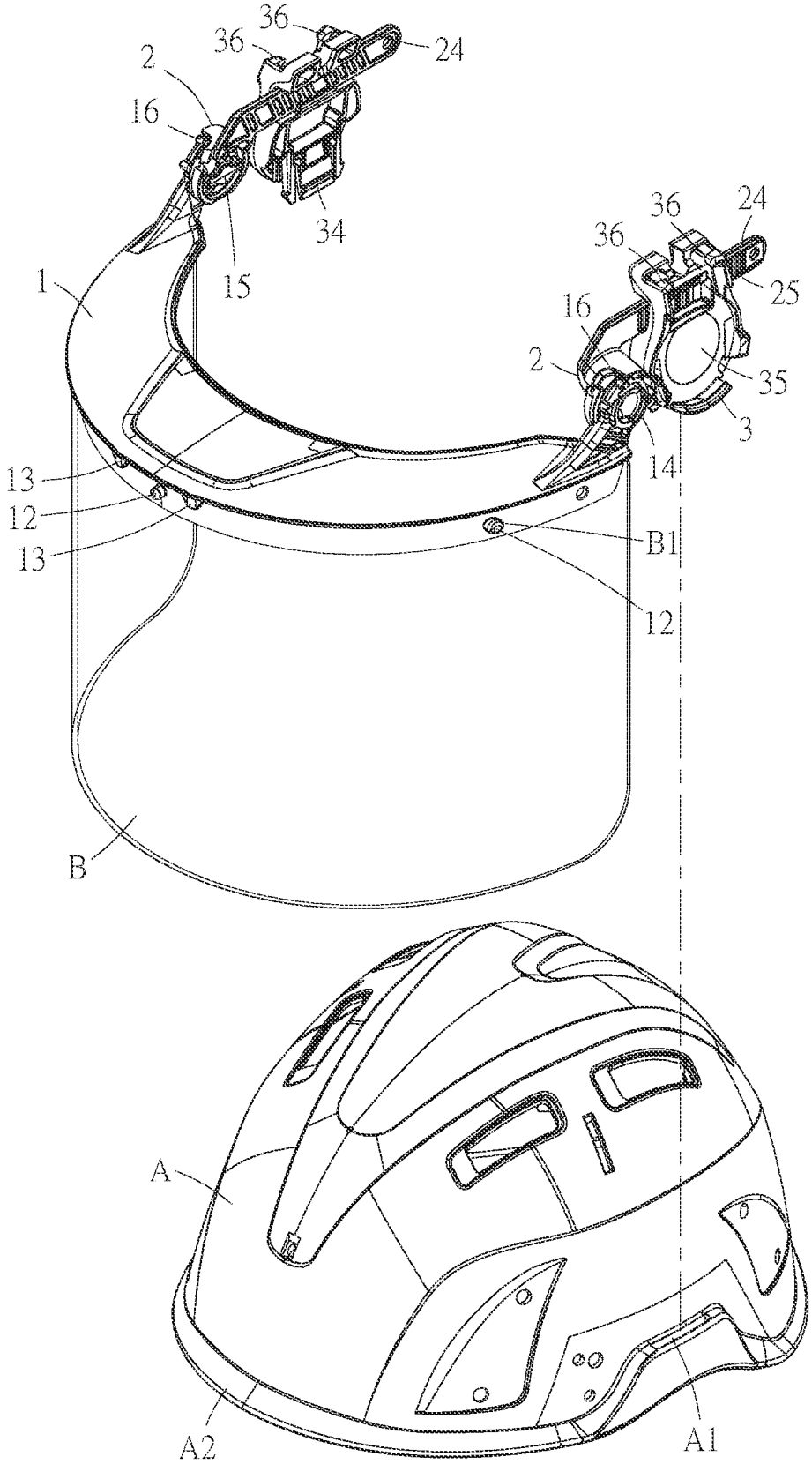
FIG. 7 is a schematic view showing the embodiment of the present invention secured to a safety helmet when in use.
Figure 8:
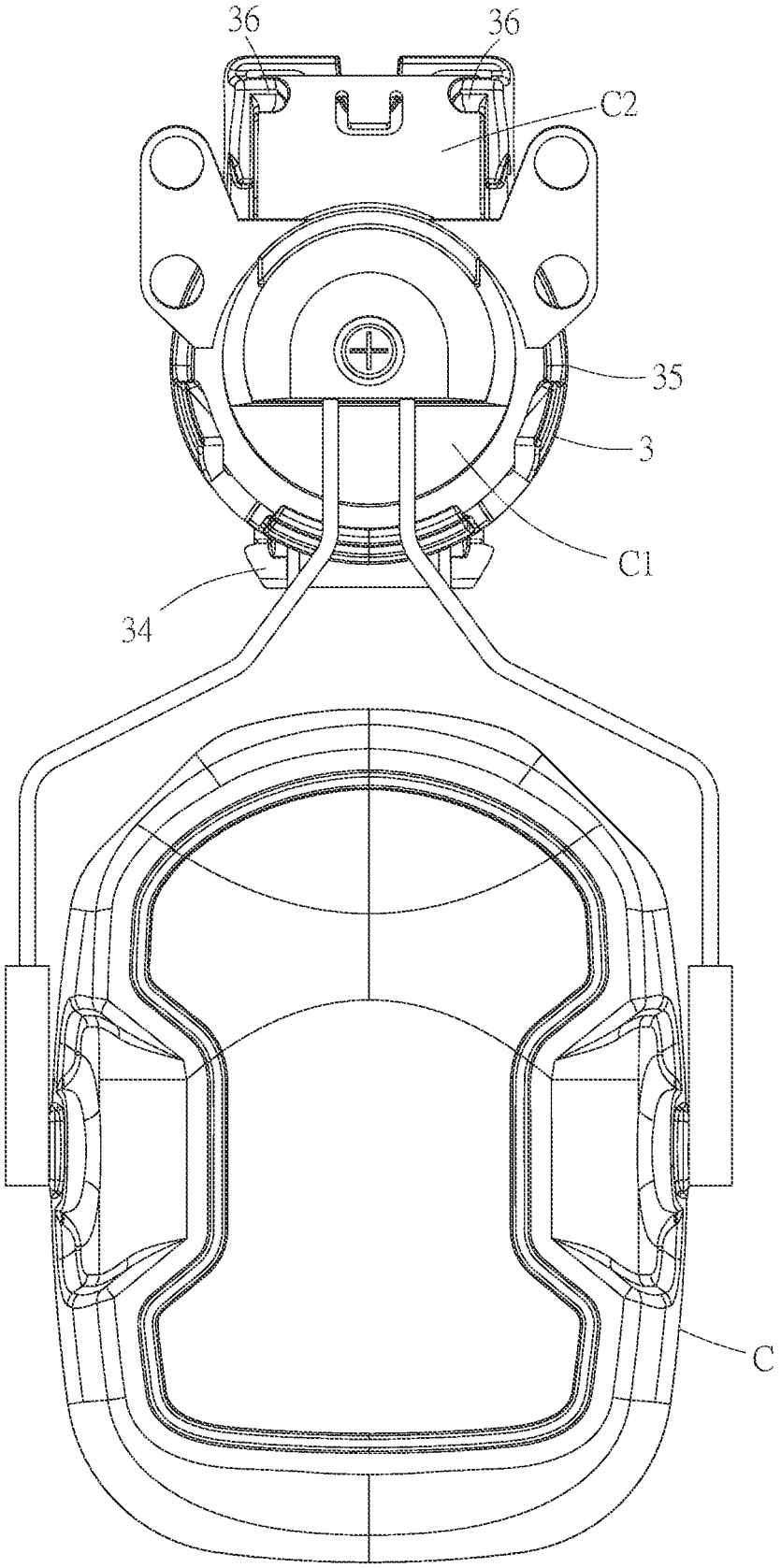
FIG. 8 is a schematic view showing the embodiment of the present invention in cooperation with an earmuff when in use.
Figure 9:
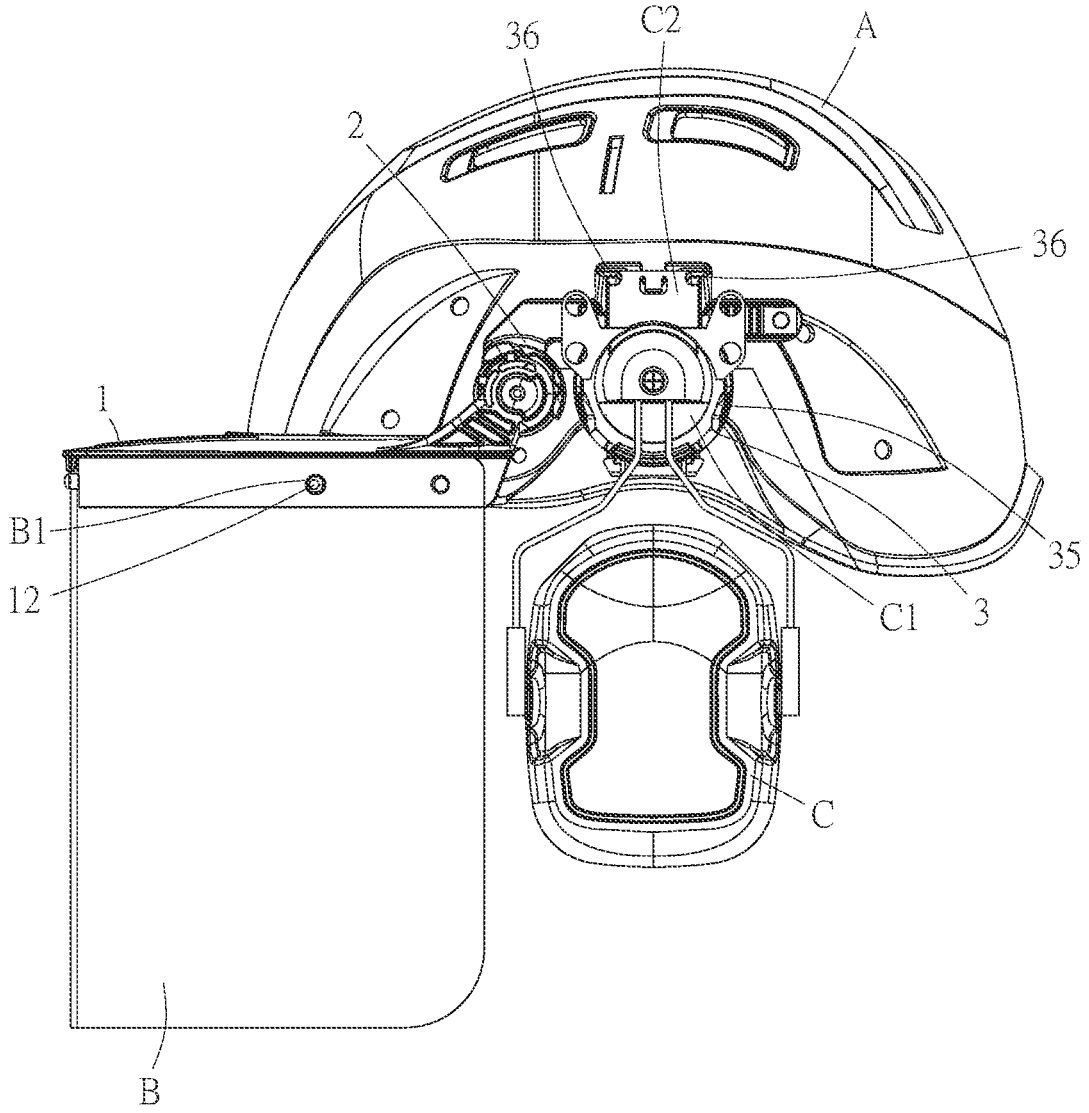
FIG. 9 is a schematic view showing the earmuff secured to the connecting unit of the embodiment of the present invention.
Figure 14:
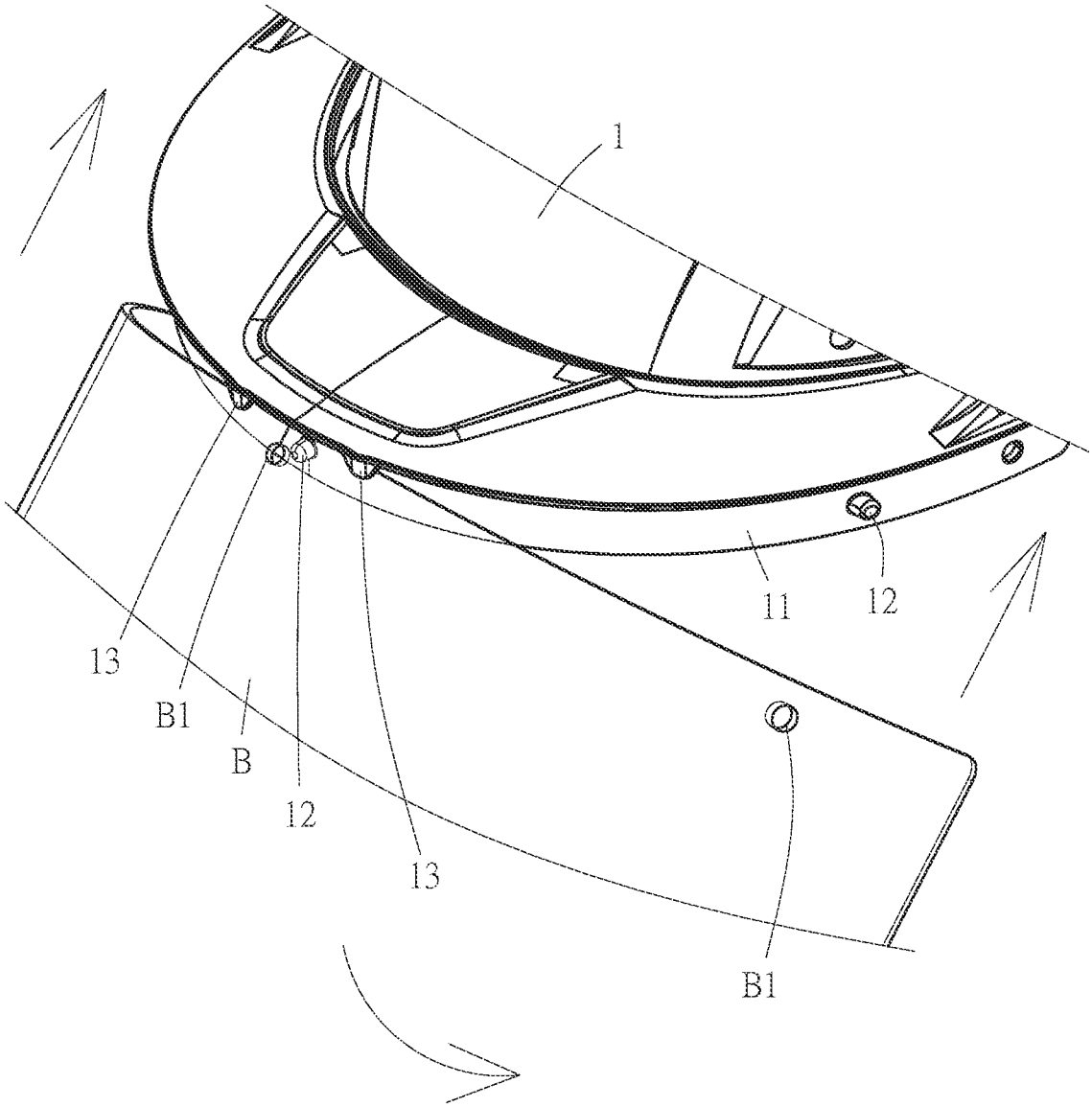
FIG. 14 is a schematic view of the embodiment of the present invention, wherein the lens is inserted obliquely between the stop piece and the retaining face.

When in use, as shown in FIG. 7, FIG. 8 and FIG. 9, the present invention cooperates with a safety helmet A, a lens B and two earmuffs C. A fitting groove A1 is formed on either side of the safety helmet A. The top edge of the lens B has a plurality of positioning holes B1. The earmuff C includes a locking block C1 on an upper end thereof and a protruding plate C2 on the top edge of the locking block C1. First, the upper edge of the lens B is inserted between the stop piece 13 on the front edge of the retaining frame 1 and the top edge of the retaining face 11 (as shown in FIG. 14). Then, a force is applied to the upper edge of the lens B, so that the positioning posts 12 of the retaining frame 1 are inserted into the positioning holes B1 of the lens B to be positioned one by one. The stop piece 13 on the top edge of the retaining face 11 is configured to prevent the lens B from detaching from the retaining frame 1. Then, the protruding plate C2 of the earmuff C is inserted in the two stoppers 36 of the connecting unit 3. A force is applied to the locking block C1 of the earmuff C for the locking block C1 to be locked in the locking portion 35 of the connecting unit 3, and the protruding plate C2 of the locking block C1 is engaged in the two stoppers 36 of the locking portion 35, so as to prevent the earmuff C from detaching from the connecting unit 3. Then, the elastic insert 34 of the connecting unit 3 is embedded and secured in the fitting groove A1 on either side of the safety helmet A, so that the lens B and the earmuffs C are combined with the safety helmet A quickly and easily, so as to protect the user's eyes and face and prevent noise interference or injury. The elastic insert 34 of the connecting unit 3 in the embodiment of the present invention can be embedded and secured in the fitting groove A1 of the general safety helmet A. Therefore, various safety helmets A sold in the market can be used in conjunction with the connecting unit 3 of the embodiment of the present invention.

Figure 10:
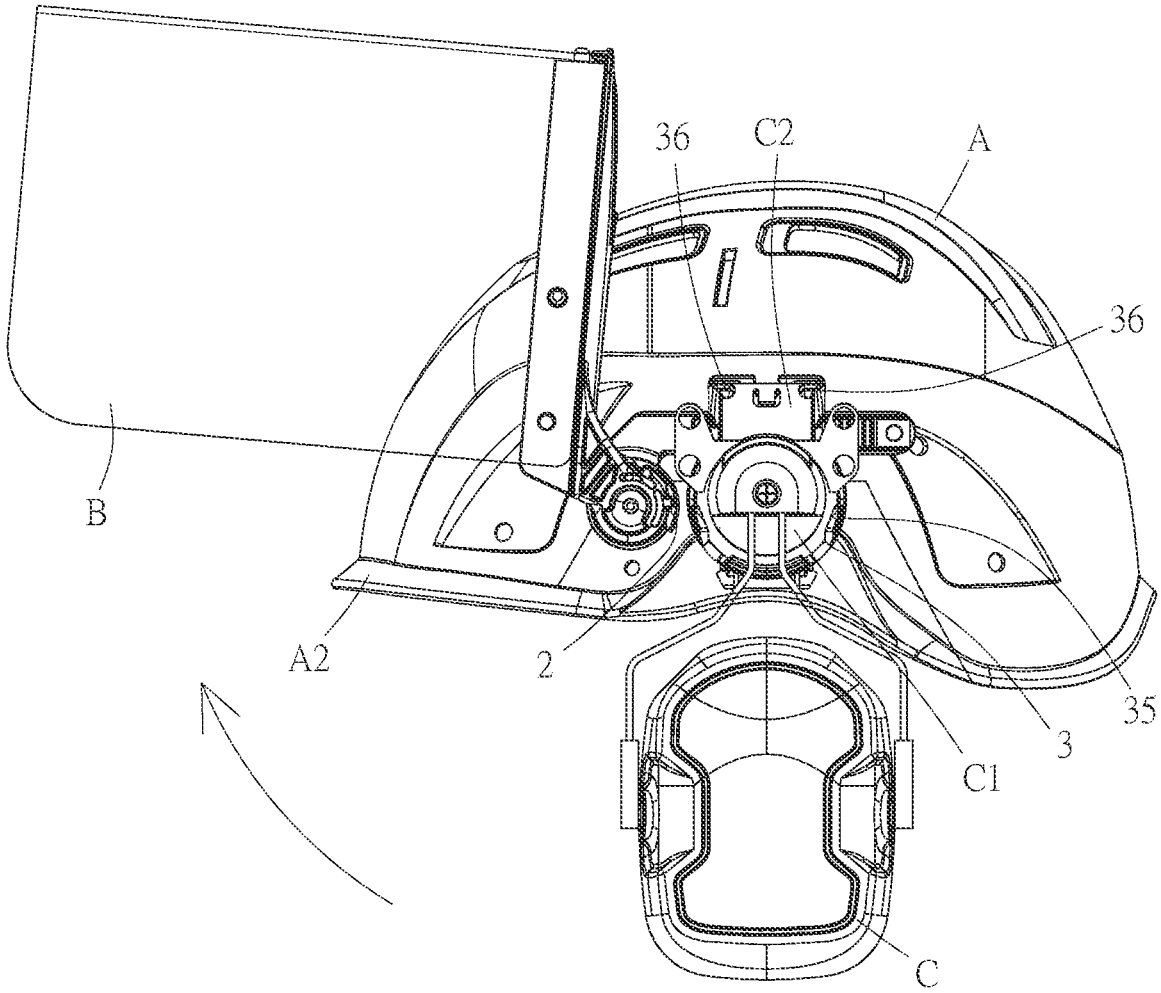
FIG. 10 is a schematic view of the embodiment of the present invention, wherein the lens is flipped upward relative to the retaining frame.
Figure 11:
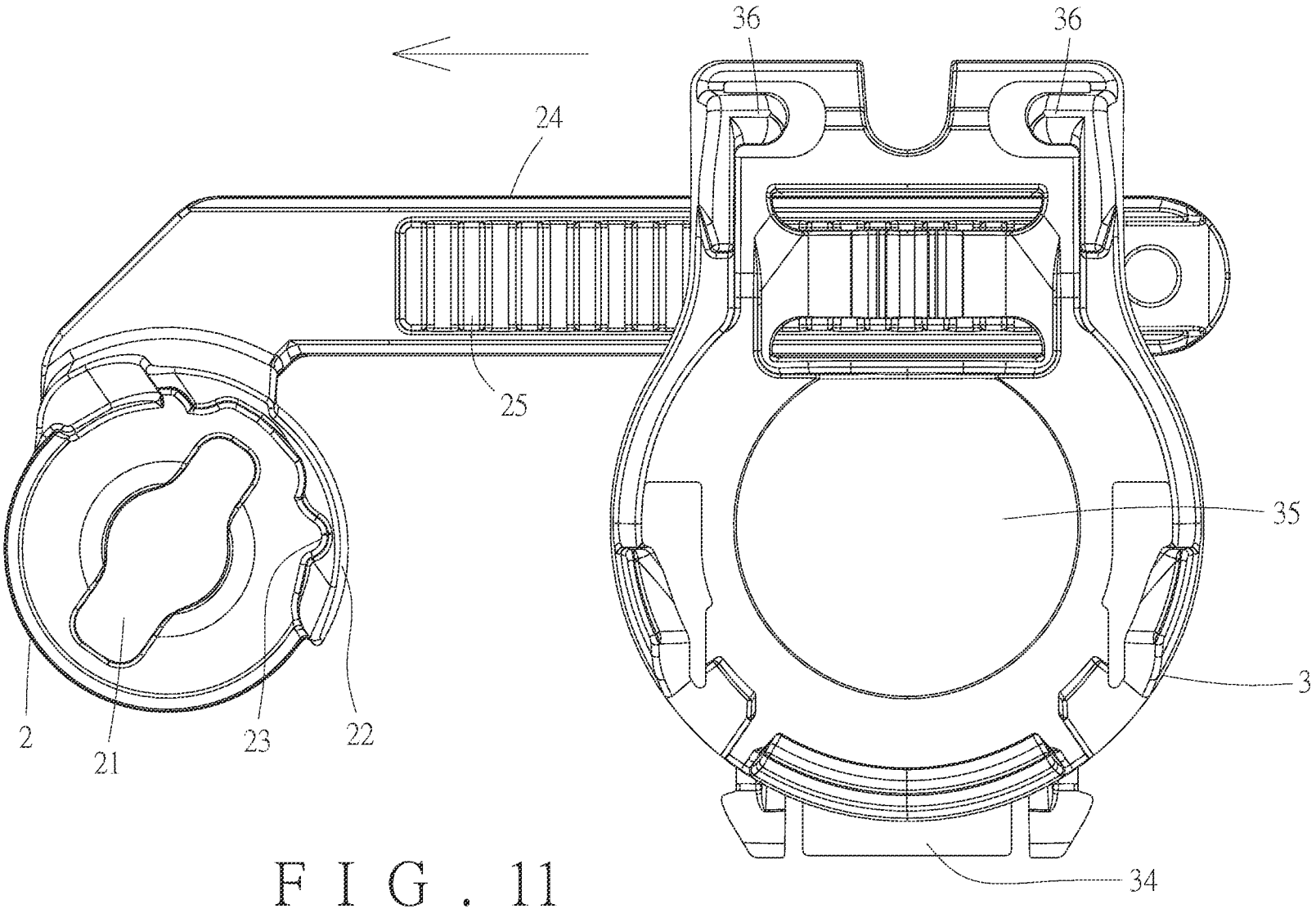
FIG. 11 is a schematic view of the embodiment of the present invention, wherein the positioning strip is moved relative to the connecting unit.
Figure 12:
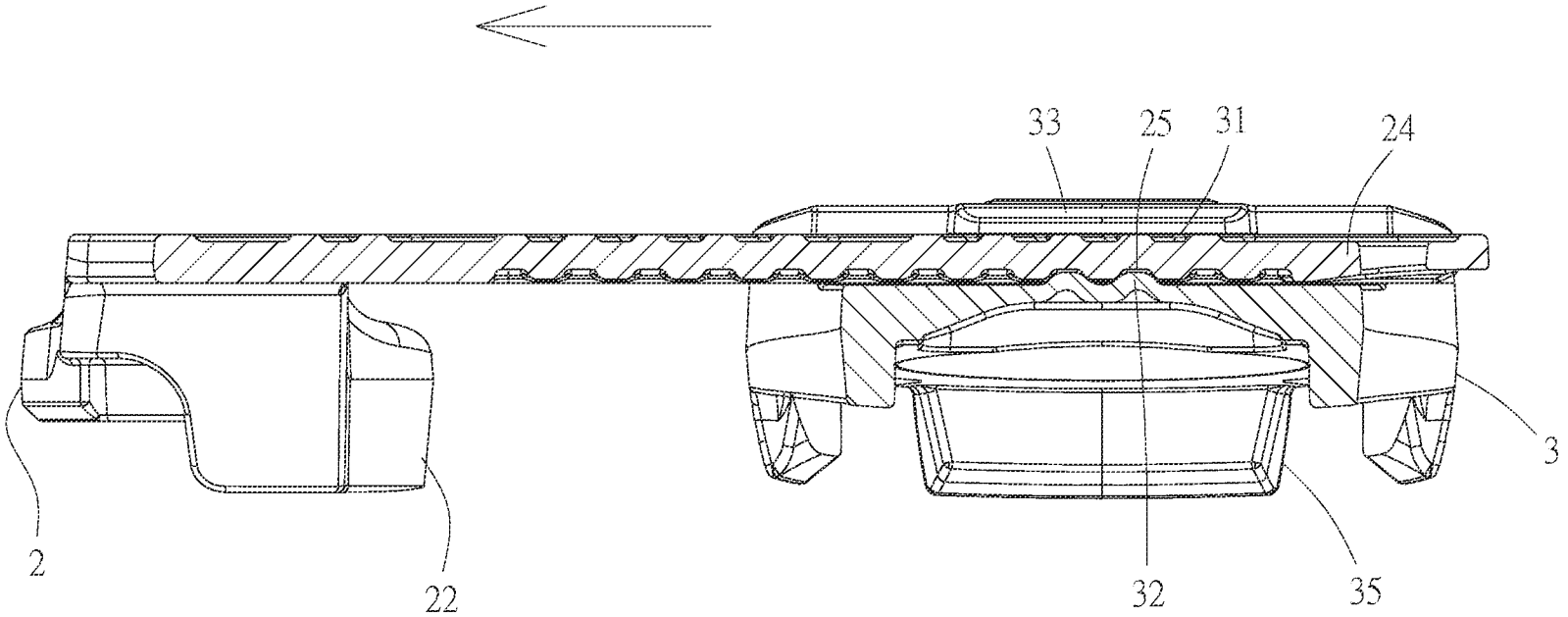
FIG. 12 is a cross-sectional view of the embodiment of the present invention, wherein the positioning strip is moved relative to the connecting unit.

As shown in FIG. 10, FIG. 11 and FIG. 12, when it is necessary to match the length of the brim A2 of a different safety helmet A and the length of the lens B needs to be extended, the positioning strip 24 of the pivot member 2 is moved relative to the connecting unit 3, such that the second pressing block 32 on the inner wall of the second slide groove 31 of the connecting unit 3 can be positioned in any one of the second grooves 25 in a multi-step manner. The pivot member 2 and the retaining frame 1 (and the lens B) connected with the pivot member 2 can slide and extend out an appropriate length relative to the connecting unit 3.

When it is necessary to flip the lens B to match the height of a different safety helmet A, the protruding length of the lens B is first adjusted, so that when the lens B is flipped, it will not interfere with the length of the brim A2 and the height of the safety helmet A. When the lens B is to be flipped, the pivot portion 14 of the retaining frame 1 is turned relative to the pivot member 2 (as shown in FIG. 13). The first pressing block 16 is forced to be positioned in the first groove 23, so that the retaining frame 1 is turned to an appropriate angle relative to the pivot member 2.

In this way, the embodiment of the present invention utilizes three components, the retaining frame 1, the pivot member 2 and the connecting unit 3, to secure the lens B and the earmuffs C on the safety helmet A for use. There will be no disadvantage that only one of the lens B and the earmuff C can be used. Therefore, the components are very simple, and the assembly and disassembly are relatively easy. Besides, the present invention is suitable for the fitting and use of the general safety helmet A. There is no need to use another mold for manufacturing a lens B or an earmuff C that can cooperate with the safety helmet. Therefore, the manufacturing cost and the man-hours can be reduced greatly. Compared with the prior art that includes more than four components, the embodiment of the present invention includes three components to achieve the function of connecting earmuffs. Therefore, the embodiment of the present invention can optimize the overall structure, use fewer components, reduce the use of plastics greatly and reduce carbon emissions, so as to reduce the carbon footprint. The present invention can respond to the demand for carbon reduction, so as to meet the requirements of environmental protection, fulfill the social responsibility of the enterprise, comply with the trend in carbon reduction, and take into account sustainable development and enterprise survival.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A device for connecting a lens and an earmuff to a safety helmet, comprising:

a retaining frame including a pivot portion coupled integrally to either side of the retaining frame, said pivot portion being configured with an engaging block positioned on an inner side of the pivot portion in an integral connection therewith, and a first pressing block on a periphery of the pivot portion;

two pivot members, each pivot member of said two pivot members being pivotally connected to a respective pivot portion of the retaining frame, said each pivot member having an engaging slot corresponding in position and in shape to the engaging block, the engaging slot having a width greater than that of the engaging block for the engaging block to pass through the engaging slot, the each pivot member being rotatably connected to the respective pivot portion, a slide portion being provided on a periphery of the each pivot member and corresponding in position to the first pressing block, the slide portion having at least one first groove, wherein, when the respective pivot portion is turned relative to the pivot member, the first pressing block is forced to be positioned in the at least one first groove, so that the retaining frame is turned to an angle relative to the pivot member, the each pivot member further including a positioning strip connected integrally, at one end thereof, to said slide portion of said each pivot member, said positioning strip extending backward from said each pivot member and having a plurality of second grooves arranged continuously on an outer side of the positioning strip;

two connecting units, each connecting unit of said two connecting units being coupled to a respective pivot member of the two pivot members, the each connecting unit having a second slide groove on an inner side thereof, the positioning strip being inserted and slidable in the second slide groove, a second pressing block being disposed on an inner wall of the second slide groove, wherein the second pressing block is pressed into a respective one of the second grooves in a multi-step manner, thus permitting the each pivot member to slide and extend to a length relative to the each connecting unit, the connecting unit further including an elastic insert.

2. The device as claimed in claim 1, wherein the retaining frame further includes a curved retaining face on a front edge thereof, a plurality of positioning posts on the retaining face, and at least one stop piece protruding from a top edge of the retaining face.

3. The device as claimed in claim 2, wherein a top edge of the lens has a plurality of positioning holes, the positioning posts of the retaining frame are inserted and positioned in the respective positioning holes of the lens, and the stop piece is configured to prevent the lens from detaching from the retaining frame.

4. The device as claimed in claim 1, wherein the engaging block is a linear block, and the at least one first groove is a linear groove.

5. The device as claimed in claim 1, wherein positioning blocks are disposed on upper and lower sides of the second groove, so as to prevent the positioning strip from sliding out of the second groove.

6. The device as claimed in claim 1, wherein a fitting groove is formed on either side of the safety helmet, and the elastic insert is embedded and secured in the fitting groove.

7. The device as claimed in claim 1, wherein the elastic insert is located below the second slide groove.

8. The device as claimed in claim 1, wherein the each connecting unit further includes a locking portion on an outer side thereof and two stoppers above the locking portion.

9. The device as claimed in claim 8, wherein the earmuff is locked to a respective connecting unit of said two connecting units, wherein the earmuff includes a locking block on an upper end thereof and a protruding plate on a top edge of the locking block, wherein the locking block is locked in the locking portion, and the protruding plate is engaged in the two stoppers, thus preventing the earmuff from detaching from the respective connecting unit.

* * * * *